US008371455B2

(12) United States Patent
Kim

(10) Patent No.: US 8,371,455 B2
(45) Date of Patent: Feb. 12, 2013

(54) FRAMELESS DISPLAY STAND

(75) Inventor: David Jaewook Kim, Glenview, IL (US)

(73) Assignee: Photogator, inc., Glenview, IL (US)

( * ) Notice: Subject to any disclaimer, the term of this patent is extended or adjusted under 35 U.S.C. 154(b) by 0 days.

(21) Appl. No.: 12/899,215

(22) Filed: Oct. 6, 2010

(65) Prior Publication Data

US 2011/0084183 A1 Apr. 14, 2011

Related U.S. Application Data

(60) Provisional application No. 61/250,374, filed on Oct. 9, 2009.

(51) Int. Cl.
*A47F 7/00* (2006.01)

(52) U.S. Cl. ..... 211/49.1; 211/50; 248/346.01

(58) Field of Classification Search ..... 248/346.01, 248/346.03, 346.06, 121, 188.1, 225.1; 273/150, 273/148 A; 40/124.01, 124.07, 124.2, 124.4, 40/124.05, 124.06; 211/44, 45, 50, 49.1; 206/425

See application file for complete search history.

(56) References Cited

U.S. PATENT DOCUMENTS

| | | | | | |
|---|---|---|---|---|---|
| 1,588,618 | A | * | 6/1926 | Rosen | 273/150 |
| 2,742,292 | A | * | 4/1956 | McDonough | 273/150 |
| 2,785,901 | A | * | 3/1957 | McLemore | 273/150 |
| 4,291,882 | A | * | 9/1981 | Del Monte | 273/148 A |
| D366,675 | S | * | 1/1996 | Milojevich | D19/90 |
| 5,890,603 | A | * | 4/1999 | Arguin et al. | 211/45 |
| D413,930 | S | * | 9/1999 | Ancona et al. | D19/90 |
| D454,702 | S | * | 3/2002 | Doeing | D6/310 |
| 2003/0089829 | A1 | * | 5/2003 | Brandzel et al. | 248/68.1 |

* cited by examiner

*Primary Examiner* — Ramon Ramirez
*Assistant Examiner* — Todd M Epps

(57) ABSTRACT

A card holder has at least one slot into which cards and/or photos may be inserted. The card holder may include two curved slots that may provide vertical stability to a card inserted in one of the curved slots. The card holder may include a straight slot that may be used to accommodate thicker card stock paper. The slots in the card holder may have teeth to help grip the card/photo more securely to keep them in place. When not in use, the card holders may conveniently and securely stack on top of each other for storage.

5 Claims, 3 Drawing Sheets

FRAMELESS DISPLAY STAND

CROSS-REFERENCE TO RELATED APPLICATIONS

The present invention claims the benefit of priority of U.S. Provisional patent application No. 61/250,374, filed Oct. 9, 2009, which is herein incorporated by reference.

BACKGROUND OF THE INVENTION

The present invention relates to display stands and, more particularly, to frameless stand featuring slots for the purpose of holding holiday cards, photographs, cards and the like.

Current card holders (paperclip and pincer variety) do not hold thinner photo paper upright effectively. The cards held by these current card holders may bend backward or forward. The current device holds a photo or card at a single point, which does not provide much vertical stability to the card, unless it is thick. Even then, however, unless the card is centered, it tends to lean to either side. In addition, the clips can also be stretched so that they do not hold thinner cards effectively after holding a thicker card.

As can be seen, there is a need for a card holder that effectively holds flat cards and photos, as well as folded cards, upright.

SUMMARY OF THE INVENTION

In one aspect of the present invention, a card holder comprises a base unit; at least two holding ribs disposed on the base unit; and a slot formed between the at least two holding ribs, the slot adapted to receive and hold at least a portion of an edge of a card.

In another aspect of the present invention, a card holder comprises a base unit; a plurality of holding ribs disposed on the base unit; a front curved slot, a rear curved slot, and a straight central slot formed between the holding ribs, the slots adapted to receive and hold at least a portion of an edge of one or more cards; and holding nubs disposed on the holding ribs, the holding nubs extending from the holding ribs into the slots.

These and other features, aspects and advantages of the present invention will become better understood with reference to the following drawings, description and claims.

DETAILED DESCRIPTION OF THE INVENTION

Figure 1:
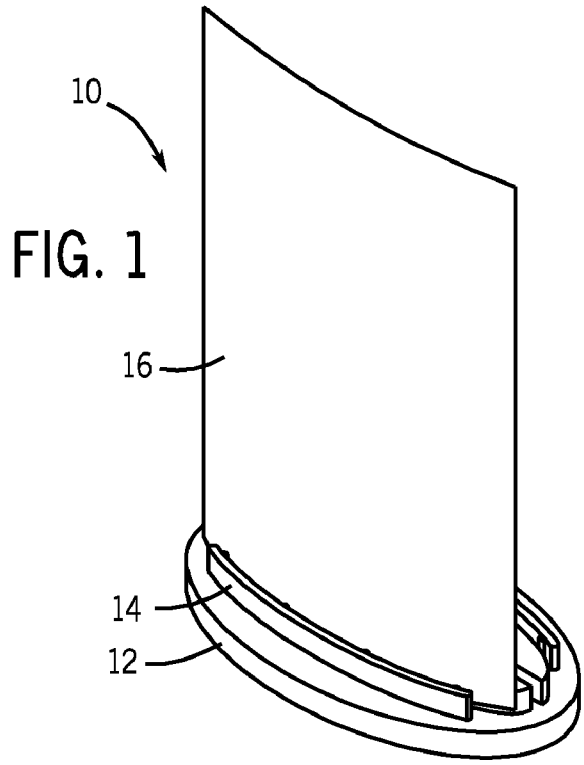
FIG. 1 is a perspective view of a display stand having a card disposed therein, according to an exemplary embodiment of the present invention.
Figure 2:
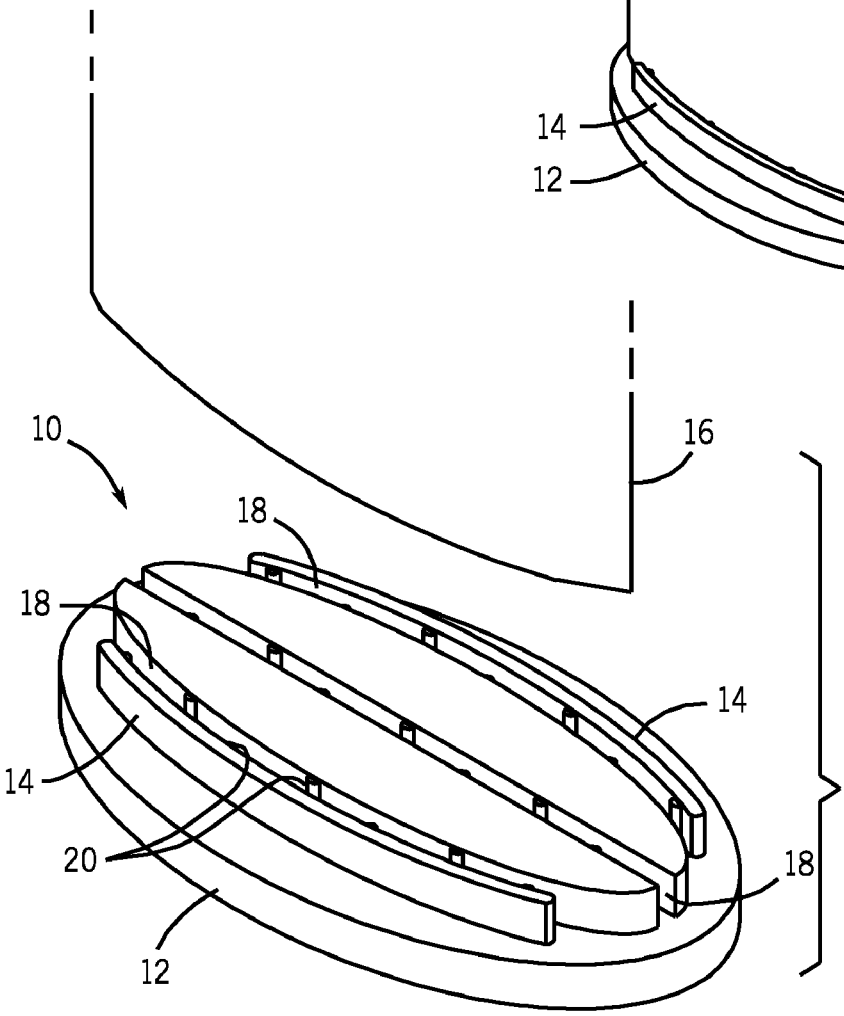
FIG. 2 is an exploded view of the display stand of FIG. 1.
Figure 3:
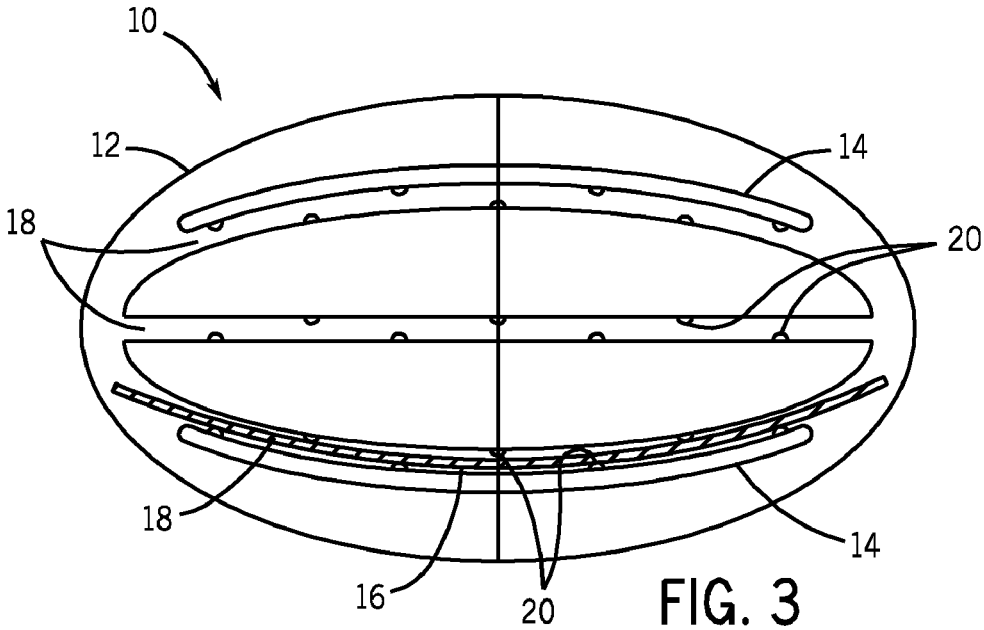
FIG. 3 is a top view of the display stand of FIG. 1.
Figure 4:
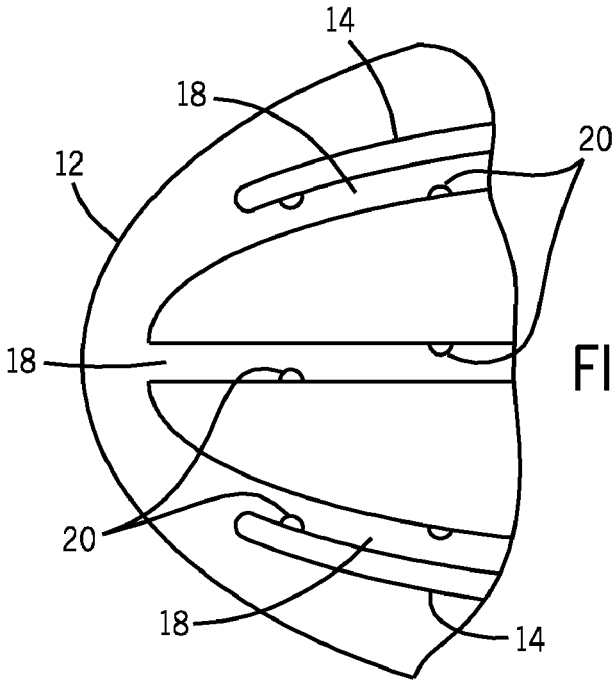
FIG. 4 is a close-up top view of the display stand of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a card holder having at least one slot into which cards and/or photos may be inserted. In some embodiments, the card holder may include two curved slots that may provide vertical stability to a card inserted in one of the curved slots. The card holder may include a straight slot that may be used to accommodate thicker card stock paper. The slots in the card holder may have teeth to help grip the card/photo more securely to keep them in place.

Referring to FIGS. 1 through 4, a card holder 10, which may also be referred to as the photogator card holder, may include a base unit 12 and one or more holding ribs 14 attached to the base unit. In some embodiments, the base unit 12 may be integral with the holding ribs 14, both formed as a single unit.

A slot 18 may be formed between adjacent ribs 14. The slot 18 may secure at least a portion of an edge of a card 16. Holding nubs 20 may be disposed on the ribs 14, extending into the slot 18. The holding nubs 20 may help secure the card 16 in the slot 18. In some embodiments, the holding nubs 20 may be equally spaced and alternate between adjacent holding ribs 14 in the slot 18 (as shown, for example, in FIGS. 3 and 4). As used herein, the term "card" refers to a product having an edge that may fit into and be retained by the slot 18. A card may be a greeting card, a photo, an advertisement, a business card, a paper product, or the like.

In some embodiments, the card holder 10 may have three slots 18—two curved slots at the front and back of the card holder 10, and one straight slot transversing a central region of the card holder 10. The base unit 12 may have an oval shape, wherein the radius of curvature of the oval may be the same as the radius of curvature of the curved slots. In some embodiments, the radius of curvature of the slots may be greater than the radius of curvature of the base unit 12.

The card holder 10 may be an oval having a long diameter of about 3 inches and a short diameter of about 2 inches. The card holder 10 may be about ⅝ inches high and may rest on any flat surface. In an alternate embodiment, a card holder may be designed with a single, central, straight slot. In this alternate embodiment, the card holder may be about 50% of the size of the above-described card holder. Such a card holder may be suitable for holding and displaying baseball/trading cards, for example.

The card holder 10 may be made from materials known in the art. For example, the card holder 10 may be made from plastic, recycled plastic, metal, wood or the like. While the card holder 10 described above is described as being oval, other shaped may be contemplated within the scope of the present invention. For example, a square, circular or rectangular card holder may be designed.

Figure 5:
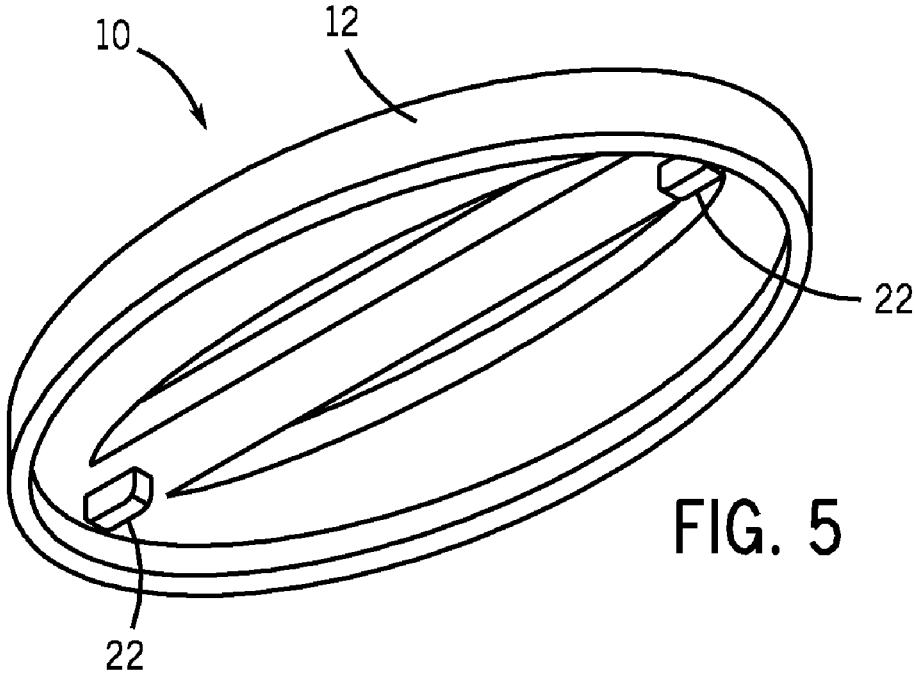
FIG. 5 is a bottom perspective view of the display stand of FIG. 1.
Figure 6:
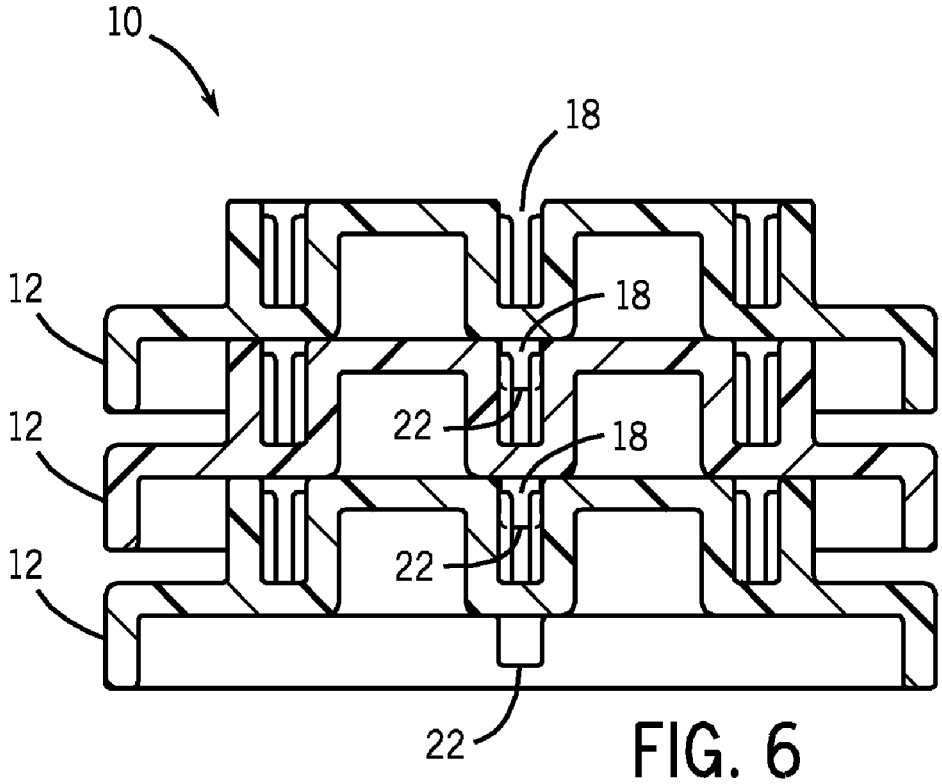
FIG. 6 is a cross-sectional view showing multiple display stands stacked together.

Referring now to FIGS. 5 and 6, the card holder 10 may include one or more, typically two, stacking alignment nubs 22 formed inside a bottom region of the card holder 10. As shown in FIG. 6, when two or more card holders are stacked on top of each other, the stacking alignment nubs 22 of an upper card holder may fit into a slot of a lower, adjacent card holder. This configuration may allow convenient and stable stacking of the card holders when they are not in use.

It should be understood, of course, that the foregoing relates to exemplary embodiments of the invention and that modifications may be made without departing from the spirit and scope of the invention as set forth in the following claims.

What is claimed is:

1. A card holder comprising:

a base unit;

at least two sets of holding ribs disposed on the base unit;

at least two slots formed between each of the at least two sets of holding ribs, each slot adapted to receive and hold at least a portion of an edge of a card, wherein a first one of the at least two slots runs parallel with a longitudinal axis of the base unit, and a second one of the at least two slots is horizontally arcuate with respect to the longitudinal axis of the base unit in order to impart a slight vertical bend in the card providing vertical stability to the card;

holding nubs disposed on the holding ribs, the holding nubs extending from the holding ribs into the slot; and at least one stacking alignment nub at a bottom side of the base unit, the stacking nub of the card holder fits into a slot of a lower card holder when the card holder is stacked on top of the lower card holder.

2. The card holder of claim 1, wherein the at least two slots includes two horizontally arcuate slots and at least one straight slot.

3. The card holder of claim 1, wherein the at least two slots includes a front horizontally curved slot, a rear horizontally curved slot and a straight slot disposed between the front curved slot and the rear curved slot.

4. The card holder of claim 1, where in the base unit has an oval shape.

5. The card holder of claim 1, wherein the holding nubs are disposed on adjacent holding ribs, alternately between adjacent holding ribs, with equal spacing between the holding nubs.

* * * * *